US005526026A

United States Patent [19]

Bowers

[11] Patent Number: 5,526,026

[45] Date of Patent: Jun. 11, 1996

[54] CONCENTRATION CONTROL FOR A CONTINUOUS INK JET PRINTER UTILIZING RESISTIVITY

[75] Inventor: Mark C. Bowers, Dayton, Ohio

[73] Assignee: Scitex Digital Printing, Inc., Dayton, Ohio

[21] Appl. No.: 210,169

[22] Filed: Mar. 17, 1994

[51] Int. Cl.[6] ..... B41J 29/38

[52] U.S. Cl. ..... 347/6; 347/7; 347/73; 347/84; 73/304 R

[58] Field of Search ..... 347/6, 7, 73, 74, 347/75, 84, 85, 89; 73/61.41, 61.43, 304 R, 305; 324/694, 695, 696

[56] References Cited

U.S. PATENT DOCUMENTS 3,761,953 9/1973 Helgeson et al. ..... 347/7
3,835,881 9/1974 Dal et al. ..... 347/7
4,121,222 10/1978 Diebold et al. .
4,196,625 4/1980 Kern ..... 347/7

OTHER PUBLICATIONS

Johnson, J. Richard; *Electronic Circuits;* Hayden Book Company; 1984; 57–59 and 67–69.

*Primary Examiner*—John E. Barlow, Jr.
*Attorney, Agent, or Firm*—Barbara Joan Haushalter

[57] ABSTRACT

A continuous ink jet printer employing conductive ink and having a main ink supply, a supplemental ink supply, and a replenishment carrier fluid supply includes a fluid system that replenishes ink or carrier fluid based on the resistivity of ink in the main ink supply.

8 Claims, 3 Drawing Sheets

CONCENTRATION CONTROL FOR A CONTINUOUS INK JET PRINTER UTILIZING RESISTIVITY

FIELD OF THE INVENTION

The present invention relates to apparatus and methods for controlling concentration in a continuous ink jet printer to maintain the desired ink resistivity.

BACKGROUND OF THE INVENTION

In a continuous ink jet printing system, conductive ink which includes a carrier fluid such as water or an organic solvent and a colorant, such as a dye or pigment is continuously recirculated through the system to a print head. The print head generates a plurality of ink drops which are selectively charged and deflected such that some of the drops fall on a print receiving medium and some of the drops are caught and recirculated. Due to evaporation of the carrier fluid during such recirculation, the colorant concentration in the recirculating ink may increase. It is desirable for proper operation of the ink jet printing system to maintain the colorant concentration in the ink to a desired predetermined range. When printing rates are high, there is very little evaporation of carrier fluid from the ink and the ink concentration can be maintained simply by adding ink from a supplemental ink supply. Alternatively, when the printing rates are low or when the printer is in an idle state with all of the ink recirculating, the evaporation rate of carrier fluid is high. In this case, it is necessary to add carrier fluid without colorant from a replenishment carrier fluid supply to maintain the colorant concentration level within the desired predetermined range for proper operation of the ink jet printing system.

Prior art ink replenishment systems have employed ink viscosity measurement or ink optical density measurement to determine the amount of replenishment carrier fluid to add to the ink to maintain the desired concentration of colorant. The electronics requirements are complex and expensive and calibration can be an inconvenience. The light source and detector(s) in the optical density measurement technique need to be recalibrated and/or changed with different inks. Furthermore, the cells through which the ink flows in the optical density measurement apparatus are quite thin and distortion of the geometry of the cells due to pressure changes in the ink can effect the accuracy of the measurement.

Another prior art system for replenishing ink in an ink jet printer is described in U.S. Pat. No. 4,121,222 issued Oct. 17, 1978 in the name of Diebold, et al. This system uses a printed drop count to determine how much replacement ink should be added and employs a balance scale to determine how much replenishment carrier fluid is needed. This system suffers from the problem that the hardware is complex and expensive. It is difficult to recalibrate when different batches of ink having slightly different concentrations of colorant and carrier fluid are used in the ink jet printer. It further suffers from the drawback that the measurement of ink by counting drops is an indirect measurement of ink volume and not as accurate as directly measuring a physical property of the ink.

There is a need therefore for an improved system for replenishing ink or carrier fluid in an ink jet printer to control ink concentration and maintain the desired ink resistivity that is easily calibrated, inexpensive and capable of maintaining the ink concentration in the ink jet printer during both high and low printing rates.

SUMMARY OF THE INVENTION

This need is met by the system and method of the present invention wherein the fluid system of a continuous ink jet printer which includes a fluid handling portion, an ink replenishment portion, and a carrier fluid replenishment portion, controls ink concentration and maintains desired resistivity. Ink used in continuous ink jet printers must be conductive so that the drops can be controlled by electrostatic deflection. As the ink evaporates, the salts which cause the ink to be conductive are left behind, causing the ink to be more conductive (i.e. lower resistivity). Thus, ink concentration is directly related to ink resistivity. The replenishment carrier fluid used in such printers does not contain the salts that make the ink conductive. Therefore, when carrier fluid is added to the ink, the conductivity of the ink is lowered (resistivity raised).

According to one aspect of the present invention, a fluid system comprises an ink resistivity cell through which ink passes as the ink is being recirculated through the fluid handling portion of the system. Calculation means calculate the resistance of the ink resistivity cell. A logic and control unit, responsive to the calculation means, controls the transfer of ink from the supplemental ink supply and the transfer of carrier fluid from the replenishment carrier fluid supply to the main ink supply, to maintain the desired ink resistivity. The volume of the ink in the main ink supply is monitored by a float valve position, and when a predetermined volume has been depleted, the predetermined volume is replaced by either ink from the supplemental ink supply or replenishment carrier fluid from the replenishment carrier fluid supply.

The fluid system and method for replenishing ink according to the present invention is simpler and less expensive than the prior art optical density, viscosity and drop counting measurement systems. The system is advantageous over the drop counting method in that any slight error in the calculated volume of each drop does not affect the ink concentration.

DETAILED DESCRIPTION OF THE INVENTION

Figure 1:
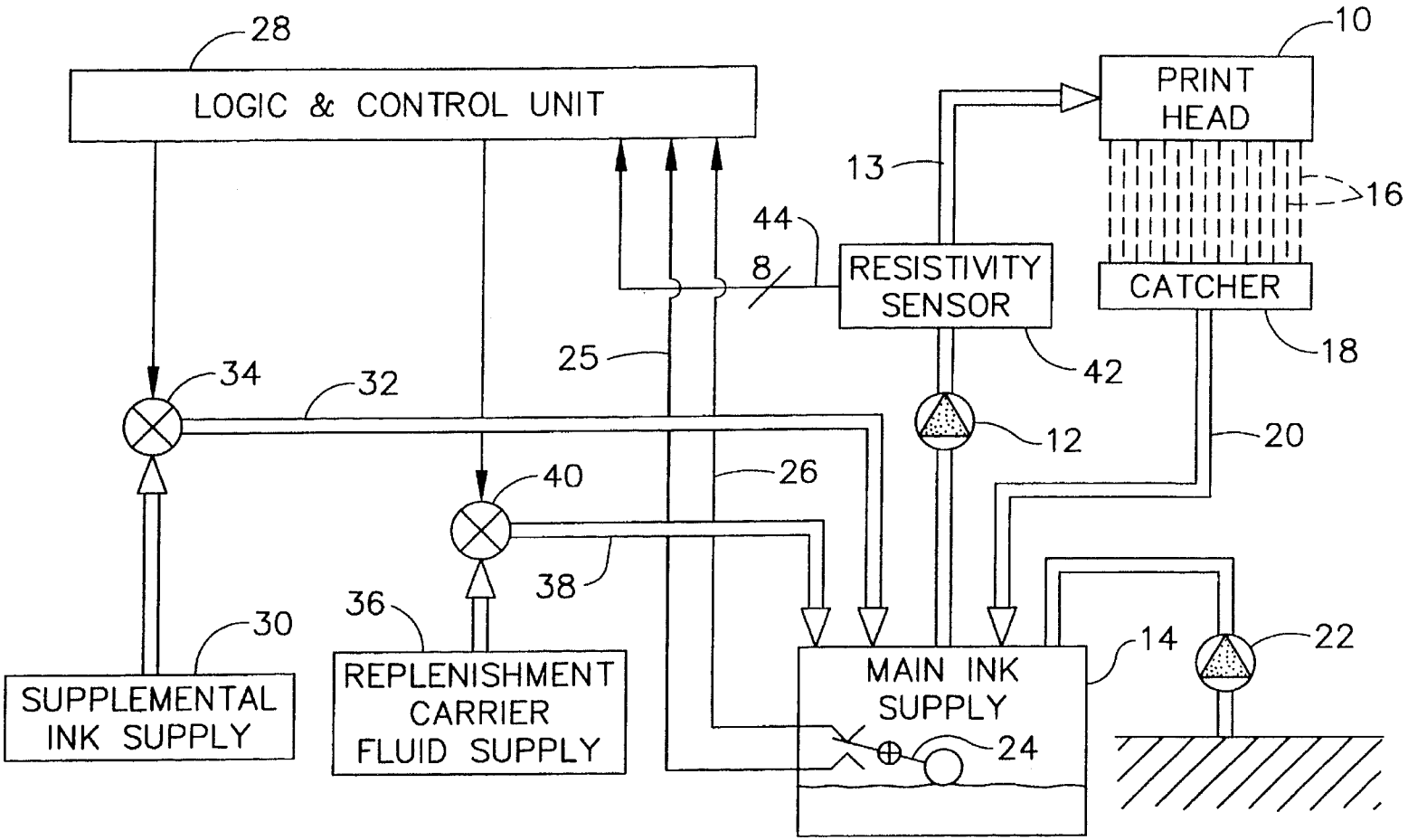
FIG. 1 is a schematic diagram of a fluid system according to the present invention.

Referring to the drawings, FIG. 1 shows a fluid system for use in a continuous ink jet printer according to the present invention. The ink jet printer includes a printhead 10 to which conductive ink is supplied under pressure by an ink pump 12 through fluid line 13 which draws ink from a main ink supply 14. The printhead 10 includes a plurality of orifices (not shown) that produce a plurality of ink jets 16 which break up into uniform streams of ink drops. Ink drops selected for printing are given an electrostatic charge different from non print drops. Ink drops which are not used for printing are directed into a catcher 18 and recirculated into the main ink supply 14 by fluid line 20. The main ink supply 14 is maintained at negative atmospheric pressure by a vacuum pump 22. Any suitable means can be employed to create the vacuum such as an aspirator or mechanical vacuum pump. The vacuum created by the vacuum pump 22 is effective in drawing the unprinted ink from the catcher 18 to the main ink supply 14. It will be clear to one skilled in the art that filters, flow restrictors and other components can be used in the ink jet printing system of the present invention without departing from the spirit or scope of the invention.

A float switch 24 located in the main ink supply 14 senses when the level of ink in the main ink supply 14 is high and when the level drops to a predetermined low level. The float switch sends a high or low signal on line 25 or 26, respectively, to a logic and control unit 28. The fluid system 10 therefore includes a fluid handling portion, an ink replenishment portion, and a carrier fluid replenishment portion.

A supplemental ink supply 30 is connected to main ink supply 14 by fluid line 32 through a normally closed valve 34. A replenishment carrier fluid supply 36 is connected to main ink supply 14 by fluid line 38 through a normally closed valve 40. Normally closed valves 34 and 40 are controlled by logic and control unit 28 to open and allow ink or replenishment carrier fluid to flow into ink supply 14 from supplemental ink supply 30 or replenishment carrier fluid supply 36 respectively. A resistivity sensor 42 located in fluid line 13 measures the resistivity of ink pumped from the main ink supply 14 to the printhead 10 and sends a signal representing the resistivity of the ink on line 44 to the logic and control unit 28.

Figure 2:
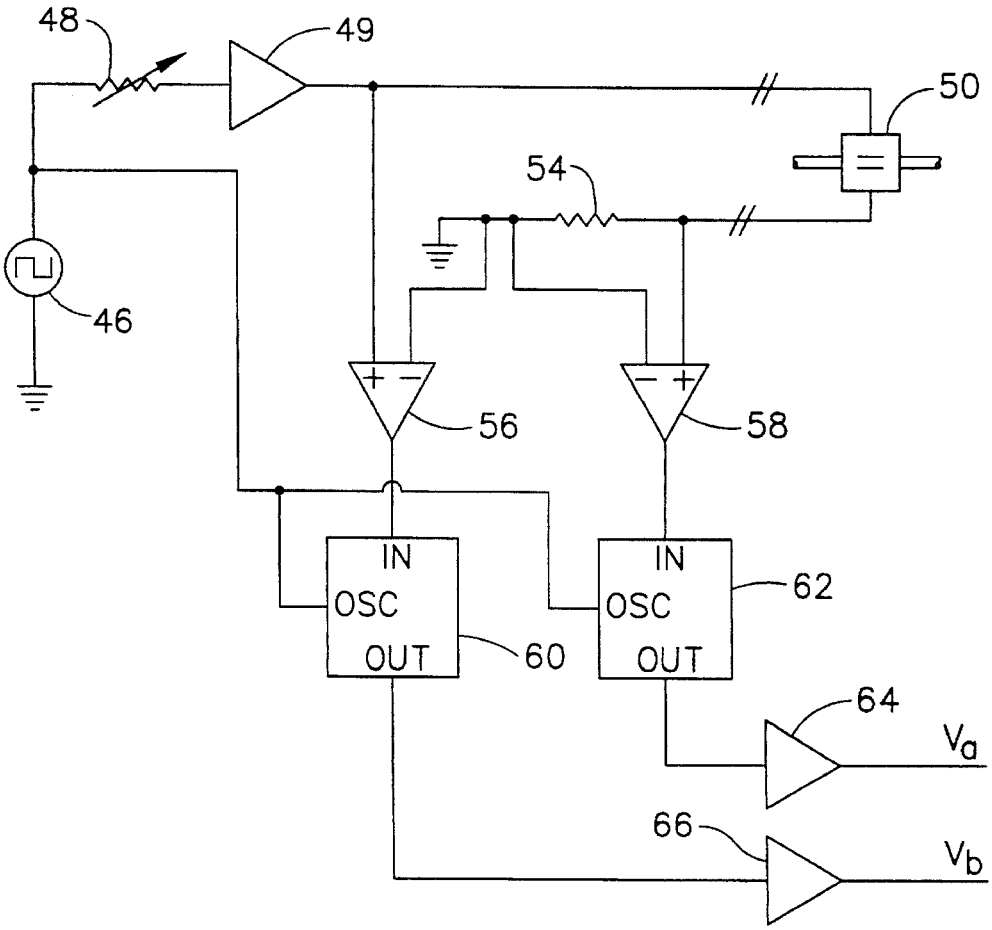
FIG. 2 is a schematic diagram illustrating the ink resistivity sensor shown in FIG. 1.

Turning now to FIG. 2, the temperature of the ink is used to adjust the resistivity value calculated to normalize the resistivity value to a standard temperature. A thermistor 52 located inside an ink cell 50 measures the temperature of the ink or fluid in the cell. The ink cell 50 is preferably of the type as disclosed in commonly assigned, co-pending application Ser. No. 07/975,495 filed Nov. 10, 1992, abandoned, the disclosure of which is totally incorporated herein by reference. The construction of the cell 50 must be such that its electrical characteristics are compatible with the fluid being used in the system. Ink passes through the ink resistivity cell 50 as the ink is being recirculated through the fluid handling portion of the system.

Figure 3:
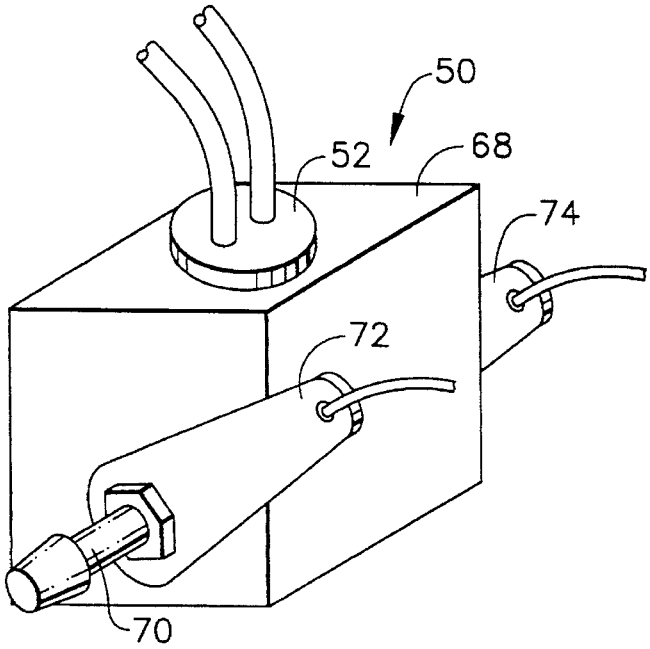
FIG. 3 is a perspective view of the ink resistivity cell employed in the ink resistivity sensor shown in FIG. 2.

The circuit of FIG. 2 further includes a square wave oscillator 46. A gain 48 is applied an AC power amplifier 49 which drives an ink resistivity cell 50. The cell 50 is located a distance away from the circuit, typically less than or equal to twenty feet. Electrode terminals 72 and 74, situated on each side of cell 50, as best illustrated in FIG. 3, provide the means to measure or otherwise calculate the resistance of the cell 50. The resistance of the cell 50 is important since the resistance of the cell is proportional to the resistivity of the ink or fluid in the system which, in turn, is proportional to the ink concentration. The terminals may be any suitable material compatible with the fluid being used, and are preferably stainless steel.

Continuing with FIG. 2, there is included in the circuit a current measuring resistor 54. The square wave drive voltage which drives the cell 50 and the value of the current measuring resistor 54 are selected per a range of ink resistivity characteristics and cell 50 dimensions. The logic and control unit 28 provides the means to activate and deactivate the drive voltage to the cell 50. AC amplifiers 56 and 58 provide gain, scaling and buffering for the system. Synchronous demodulators 60 and 62 measure the magnitude of the AC voltages. A pair of DC amplifiers 64 and 66 output a DC voltage proportional to current through cell 50, and a DC voltage proportional to the drive voltage, $V_a$ and $V_b$, respectively, which voltages are provided to A/D converters of the logic and control unit 28.

As stated previously, the resistance of the cell 50 is important since the resistance of the cell is proportional to the resistivity of the ink or fluid in the system which, in turn, is proportional to the ink concentration. The resistance of the cell, $R_c$, can be calculated from voltage measurements, as illustrated in Equation 1:

$$R_c=R*[(V_b/V_a)-1] \quad \text{(Equation 1)}$$

where R is the value of the current measuring resistor 54. In order for the resistance calculation to have any useful meaning, it has to be converted to a temperature normalized value, i.e., a normalization temperature has to be selected. Therefore, the resistance $R_c$ is normalized with respect to temperature of the fluid in the cell 50. For purposes of example, a normalization temperature of 25° C. has been chosen. It is well known in the art that resistivity varies as a function of temperature, T, according to the following well known equation, Equation 2:

$$K=C_T e^{-K/T} \quad \text{(Equation 2)}$$

where $C_T$ and K are predefined constants from electrochemical characteristics of the ink. This can also be expressed as a power series, as in Equation 3:

$$K=C_O T^{-1}+C_1+C_2T+C_3T^2+C_4T^3 \quad \text{(Equation 3)}$$

In Equation 3, the constants $C_0$, $C_1$, $C_2$, $C_3$, and $C_4$ for the power series are calculated to approximate the exponential relationship or from measured characteristics of the ink. Although an exponential is normally approximated by a power series of greater length than above, for the ink replenishment system of the present invention, a series of three, four or five terms is sufficient. Consequently, the temperature normalized cell resistance can be defined as in Equation 4:

$$R_{CN}=R_C/K \quad \text{(Equation 4)}$$

In accordance with the present invention, this normalized cell resistance is compared to a predetermined cell resistance target. The cell target is the expected cell resistance at some defined concentration, typically 100% concentration 25° C. If the concentration is less than the target, i.e., less than 100% in this example, then ink is added to the system. Conversely, if the concentration is greater than the target, i.e., greater than 100%, then replenishment is added to the system.

The target resistance is specified as the resistivity of the ink multiplied by the cell constant, as in Equation 5:

$$R_{CT}=pI_K \quad \text{(Equation 5)}$$

where the Greek symbol p (rho) represents ink resistivity in ohm-centimeters and $I_K$ is the ink cell constant in $cm_{-1}$.

FIG. 3 is a perspective view of the resistance cell 50, which includes a hollow body 68 of insulating material. A first conductive metal fitting 70 is attached to one side of the hollow body 68 through which ink can enter the hollow body. A second similar conductive metal fitting is supplied on the opposite side of the hollow body 68. Conductive lugs 72 and 74 are in electrical contact with the conductive metal fittings and provide the connections to the bridge circuit shown in FIG. 2. In operation, fluid line 13 is connected to the conductive fitting 70 and its opposite counterpart. Likewise, for conductivity sensor 46, fluid line 32 is connected to the conductive fittings.

Figure 4:
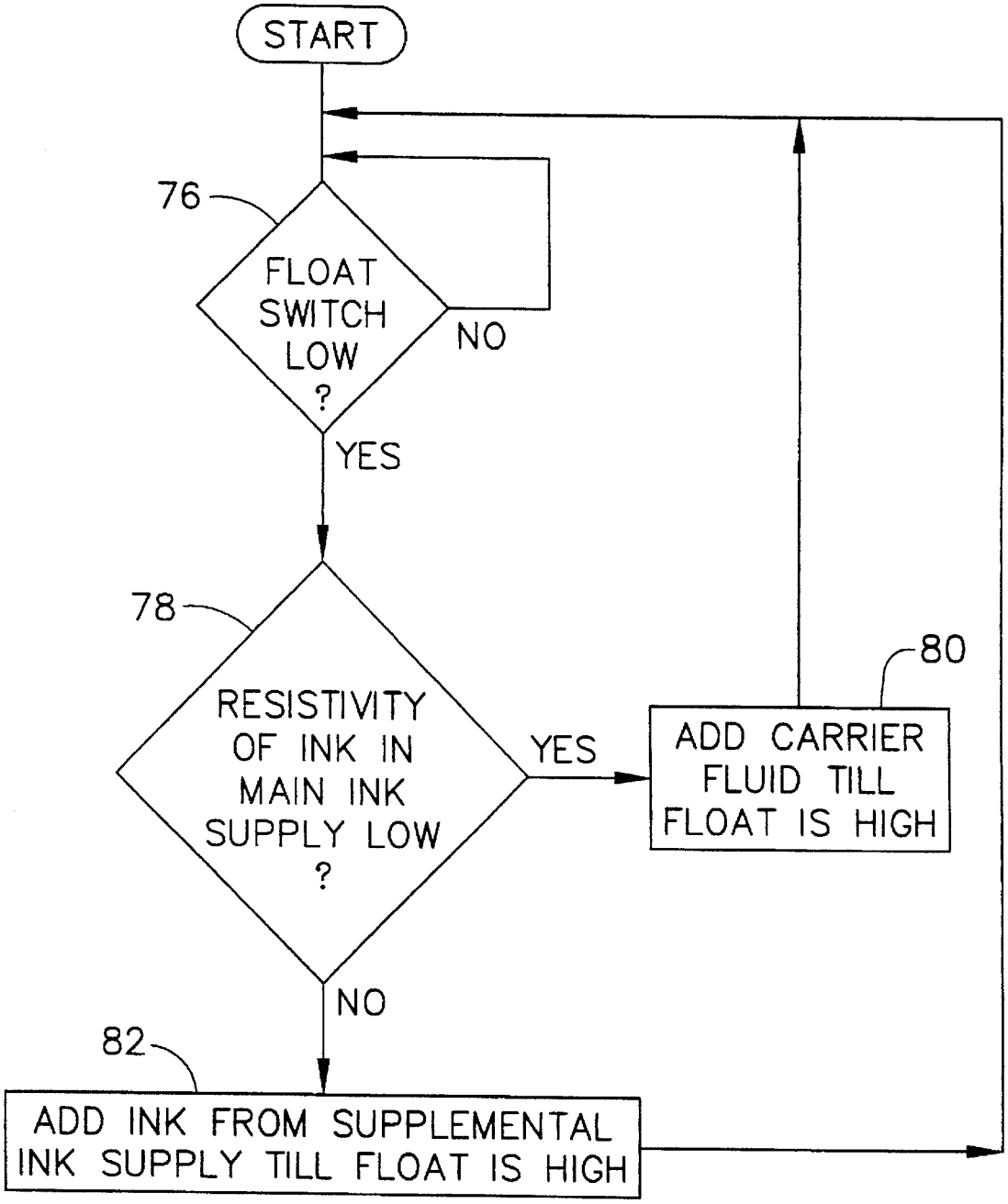
FIG. 4 is a flow diagram illustrating the control logic employed in the logic and control unit in the fluid system shown in FIG. 1.

Referring now to FIG. 1 and 4, the operation of the replenishment system under control of the logic and control unit 28 will be described. Logic and control unit 28 monitors the state of the float switch 24. When the float switch 24 indicates that the level of ink in the main ink supply 14 is low (76), the logic and control unit checks whether the resistivity of the ink in the main ink supply 14 is low (78), i.e., less than the target, thereby indicating that the concentration of colorant in the ink is high due to evaporation of carrier fluid. If the resistivity of the ink is low, the logic and control unit 28 opens valve 40 to allow replenishment carrier fluid to flow from supply 36 to the main ink supply 14 until the float switch 24 indicates that the main ink supply level is high (80). On the other hand, if the resistivity of the ink in the main ink supply 14 is not low, the logic and control unit 28 opens valve 34 to allow ink to flow from the supplemental ink supply 30 into the main ink supply 14 until the float switch in the main ink supply registers high (82). In this way, the resistivity of the ink and hence the concentration of the ink in the main ink supply is maintained at or near the desired value over time by refilling the main ink supply 14 from either the supplemental ink supply 30 or the replenishment carrier fluid supply 36 depending on the measured resistivity of ink in the main ink supply 14.

It will be apparent to one skilled in the art that other approaches to replenishing ink in a continuous ink jet printer employing resistivity of the ink are possible within the spirit and scope of the present invention. For example, the logic and control unit may calculate a proportion of supplemental ink and carrier fluid to add to the main ink supply to restore the resistivity to the desired value.

What is claimed is:

1. In a continuous ink jet printer employing conductive ink and having a main ink supply, a supplemental ink supply, and a replenishment carrier fluid supply, a fluid system having a fluid handling portion, an ink replenishment portion, and a carrier fluid replenishment portion, the fluid system comprising:

a. an ink resistivity cell through which ink passes as the ink is being recirculated through the fluid handling portion of the system;

b. calculation means for calculating resistance of the ink resistivity cell;

c. a logic and control unit having means for sensing when a predetermined volume of ink is depleted from said main ink supply, and further having means responsive to said volume sensing means for transferring said predetermined volume of ink from said supplemental ink supply to said main ink supply when the resistivity of ink in said main ink supply is above a predetermined value, and for transferring said predetermined volume of carrier fluid from said replenishment carrier fluid supply to said main ink supply when the resistivity of ink in said main ink supply is below said predetermined value, the logic and control unit responsive to the calculation means for controlling the transfer of ink from the supplemental ink supply and the transfer of carrier fluid from the replenishment carrier fluid supply to the main ink supply.

2. The fluid system claimed in claim 1 further comprising a conversion means for converting the resistance calculation to a temperature normalized value.

3. The fluid system claimed in claim 1 wherein said volume sensing means comprises a float switch located in said main ink supply.

4. The fluid system claimed in claim 1 wherein said resistivity sensing means comprises:

a hollow insulating body, a pair of conductive metal fittings for introducing ink into and out of the body, and a pair of electrical connections to said metal fittings.

5. A method of controlling ink concentration in a continuous ink jet printer employing conductive ink and having a main ink supply, a supplemental ink supply, and a replenishment carrier fluid supply, a fluid system having a fluid handling portion, an ink replenishment portion, and a carrier fluid replenishment portion, the method comprising the steps of:

a. providing an ink resistivity cell through which ink passes as the ink is being recirculated through the fluid handling portion of the system;

b. calculating resistance of the ink resistivity cell;

c. controlling the transfer of ink from the supplemental ink supply and the transfer of carrier fluid from the replenishment carrier fluid supply to the main ink supply responsive to the resistance calculation, by sensing when a predetermined volume of ink is depleted from said main ink supply, and transferring said predetermined volume of ink from said supplemental ink supply to said main ink supply when the resistivity of ink in said main ink supply is above a predetermined value, and transferring said predetermined volume of carrier fluid from said replenishment carrier fluid supply to said main ink supply when the resistivity of ink in said main ink supply is below said predetermined value, responsive to the volume sensing step.

6. The fluid system claimed in claim 5 wherein the resistivity sensing step comprises the steps of providing a hollow insulating body, a pair of conductive metal fittings for introducing ink into and out of the body, and a pair of electrical connections to said metal fittings.

7. The method claimed in claim 5 wherein said calculation step comprises the step of calculating a temperature normalization value, $R_{CN}$, according the following rule:

$$R_{CN}=R_C/K,$$

where: $R_c$ is the resistance of the cell and K is a predefined constant based on electrochemical characteristics of the ink.

8. The method claimed in claim 7 wherein the resistance of the cell, $R_C$ is related to a DC voltage proportional to current through the cell, and a DC voltage proportional to a drive voltage which drives the cell.

* * * * *